US009752204B2

(12) United States Patent
Voglewede et al.

(10) Patent No.: US 9,752,204 B2
(45) Date of Patent: Sep. 5, 2017

(54) PRECIPITATION HARDENED MATRIX DRILL BIT

(71) Applicant: Halliburton Energy Services, Inc., Houston, TX (US)

(72) Inventors: Daniel Brendan Voglewede, Spring, TX (US); Garrett T. Olsen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 305 days.

(21) Appl. No.: 14/406,093

(22) PCT Filed: Feb. 11, 2014

(86) PCT No.: PCT/US2014/015659

§ 371 (c)(1),
(2) Date: Dec. 5, 2014

(87) PCT Pub. No.: WO2015/122869

PCT Pub. Date: Aug. 20, 2015

(65) Prior Publication Data

US 2016/0258031 A1 Sep. 8, 2016

(51) Int. Cl.

| | |
|---|---|
| ***E21B 10/46*** | (2006.01) |
| ***E21B 10/54*** | (2006.01) |
| ***C21D 1/18*** | (2006.01) |
| ***E21B 10/42*** | (2006.01) |
| *E21B 10/56* | (2006.01) |

(52) U.S. Cl.

CPC ..... *C21D 1/18* (2013.01); *E21B 10/42* (2013.01); *E21B 10/54* (2013.01); *E21B 10/56* (2013.01)

(58) Field of Classification Search

CPC ..... E21B 10/00; E21B 10/26; E21B 10/36; E21B 10/46; E21B 10/54; E21B 2010/545

See application file for complete search history.

(56) References Cited

U.S. PATENT DOCUMENTS

| | | | | |
|---|---|---|---|---|
| 6,116,360 | A | 9/2000 | Evans | |
| 6,148,936 | A | 11/2000 | Evans et al. | |
| 6,287,360 | B1 * | 9/2001 | Kembaiyan | B22F 7/06 175/374 |
| 6,342,180 | B1 * | 1/2002 | Lefebvre | C22C 23/02 148/420 |

(Continued)

FOREIGN PATENT DOCUMENTS

| | | | |
|---|---|---|---|
| CN | 101016826 | A | 8/2007 |
| CN | 101542067 | A | 9/2009 |
| WO | 2015122869 | A1 | 8/2015 |

OTHER PUBLICATIONS

International Search Report and Written Opinion for PCT/US2014/015659 dated Nov. 7, 2014.

*Primary Examiner* — Cathleen Hutchins

(74) *Attorney, Agent, or Firm* — McDermott Will & Emery LLP

(57) ABSTRACT

A drill bit may include a matrix bit body and a plurality of cutting elements coupled to an exterior portion of the matrix bit body, wherein the matrix bit body includes matrix particles and precipitated intermetallic particles dispersed in a binder, at least some of the matrix particles having a diameter of 50 microns or greater, and at least some of the precipitated intermetallic particles having at least one dimension of 1 micron to 30 microns.

8 Claims, 5 Drawing Sheets

(56) References Cited

U.S. PATENT DOCUMENTS

| | | | |
|---|---|---|---|
| 6,348,110 | B1 | 2/2002 | Evans |
| 7,556,668 | B2 | 7/2009 | Eason et al. |
| 7,691,173 | B2 | 4/2010 | Eason et al. |
| 7,913,779 | B2 | 3/2011 | Choe et al. |
| 8,074,750 | B2 | 12/2011 | Choe et al. |
| 8,087,324 | B2 | 1/2012 | Eason et al. |
| 8,172,914 | B2 | 5/2012 | Mirchandani et al. |
| 8,230,762 | B2 | 7/2012 | Choe et al. |
| 8,561,731 | B2 | 10/2013 | Keshavan et al. |
| 2006/0231293 | A1 | 10/2006 | Ladi et al. |
| 2007/0102200 | A1 | 5/2007 | Choe et al. |
| 2009/0031863 | A1 | 2/2009 | Lyons et al. |
| 2011/0107586 | A1 | 5/2011 | Choe et al. |
| 2013/0000982 | A1 | 1/2013 | Olsen |

* cited by examiner

PRECIPITATION HARDENED MATRIX DRILL BIT

BACKGROUND

The present disclosure relates to matrix bit bodies, including methods of production and use related thereto.

Rotary drill bits are frequently used to drill oil and gas wells, geothermal wells and water wells. Rotary drill bits may be generally classified as roller cone drill bits or fixed cutter drill bits. Fixed cutter drill bits are often formed with a matrix bit body having cutting elements or inserts disposed at select locations about the exterior of the matrix bit body. During drilling, these cutting elements engage and remove adjacent portions of the subterranean formation.

The composite materials used to form the matrix bit body are generally erosion-resistant and have high impact strengths. However, defects in the composite materials formed during manufacturing of the matrix bit body can reduce the lifetime of the drill bit.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to a drill bit having a matrix bit body comprising precipitation hardened composite material, including methods of production and use related thereto.

In some embodiments, the matrix bit bodies of the present disclosure are formed, at least in part, with a precipitation hardened composite material that includes matrix particles and precipitated intermetallic particles dispersed in a binder. As use herein, the term "precipitated intermetallic particle" refers to a particle that include two or more metals (not carbide) that are precipitated from the binder material after infiltration of the matrix particles with the binder material.

In some embodiments, at least some of the matrix particles may have a diameter of 50 microns or greater, and at least some of the precipitated intermetallic particles may be 1 micron to 30 microns in at least one dimension. The smaller-sized precipitated intermetallic particles may enhance the erosion resistance of the matrix bit body while the larger-sized matrix particles provide strength to the matrix bit body.

In other matrix bit body forming procedures, both small and large matrix particles may be used to provide erosion resistance and strength, respectively. However, in some instances, the differently sized matrix particles tend to segregate before infiltration with the binder. When the matrix particles are infiltrated with the binder and locked in place, the segregation may result in portions of the matrix bit body that exhibit less strength (i.e., fewer large particles) and portions that exhibit less erosion resistance (i.e., fewer small particles). The variations in erosion resistance and strength within the matrix bit body provide failure points that reduce the lifetime of the drill bit.

By forming the smaller particles in situ (i.e., via the precipitation methods described herein), the smaller particles may be more homogeneously distributed through the precipitation hardened composite material as compared to a hard composite formed from mixed-sized matrix particles. Accordingly, the precipitation hardened composite material described herein may provide similar enhancements in erosion resistance and strength while mitigating the failure points associated with segregation of mixtures of large-sized and small-sized matrix particles.

Figure 1:
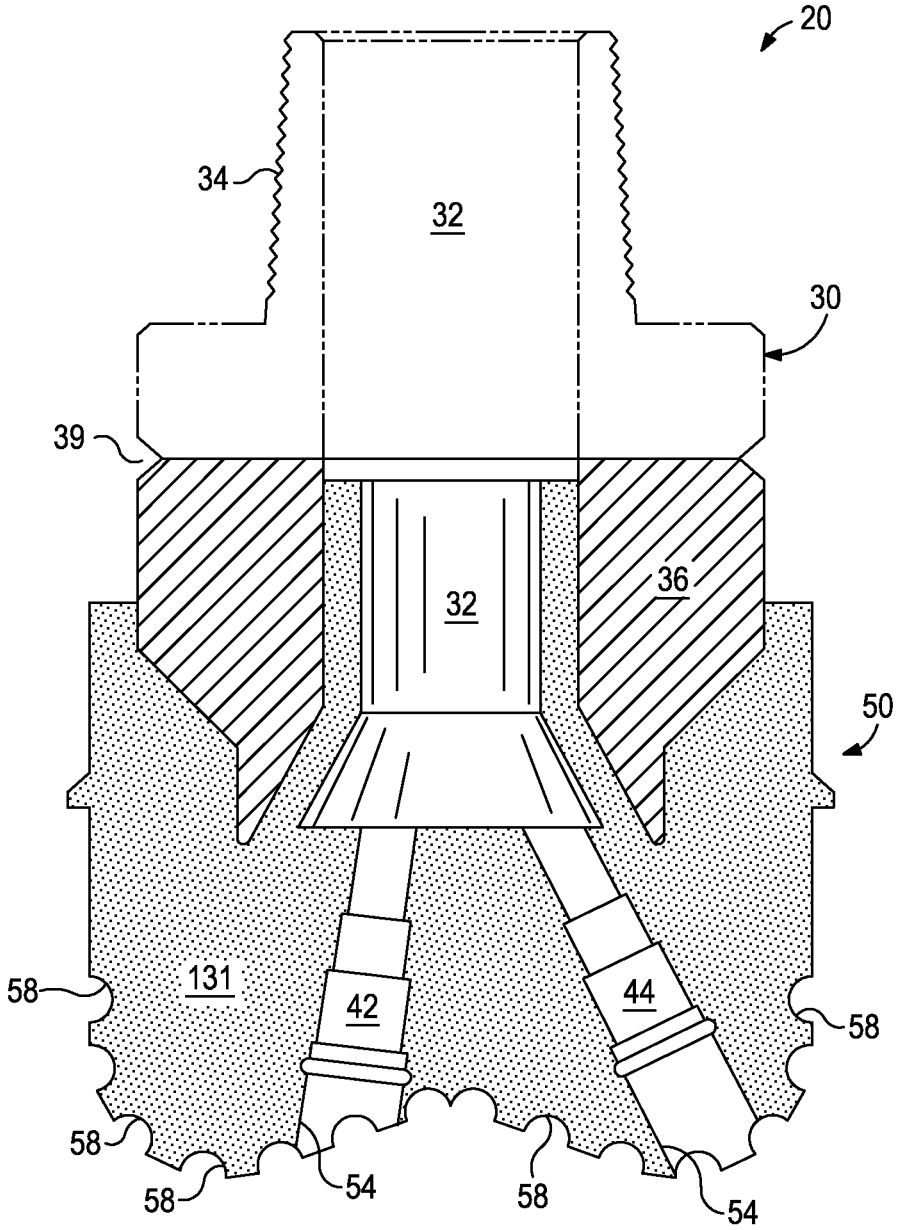
FIG. 1 is a cross-sectional view showing one example of a drill bit having a matrix bit body with at least one fiber-reinforced portion in accordance with the teachings of the present disclosure.

FIG. 1 is a cross-sectional view of a matrix drill bit 20 formed with a matrix bit body 50 that includes a precipitation hardened composite material 131 in accordance with the teachings of the present disclosure. As used herein, the term "matrix drill bit" encompasses rotary drag bits, drag bits, fixed cutter drill bits, and any other drill bit capable of incorporating the teachings of the present disclosure.

For embodiments such as shown in FIG. 1, the matrix drill bit 20 may include a metal shank 30 with a metal blank 36 securely attached thereto (e.g., at weld location 39). The metal blank 36 extends into matrix bit body 50. The metal shank 30 includes a threaded connection 34 distal to the metal blank 36.

The metal shank 30 and metal blank 36 are generally cylindrical structures that at least partially define corresponding fluid cavities 32 that fluidly communicate with each other. The fluid cavity 32 of the metal blank 36 may further extend longitudinally into the matrix bit body 50. At least one flow passageway (shown as two flow passageways 42 and 44) may extend from the fluid cavity 32 to exterior portions of the matrix bit body 50. Nozzle openings 54 may be defined at the ends of the flow passageways 42 and 44 at the exterior portions of the matrix bit body 50.

Figure 2:
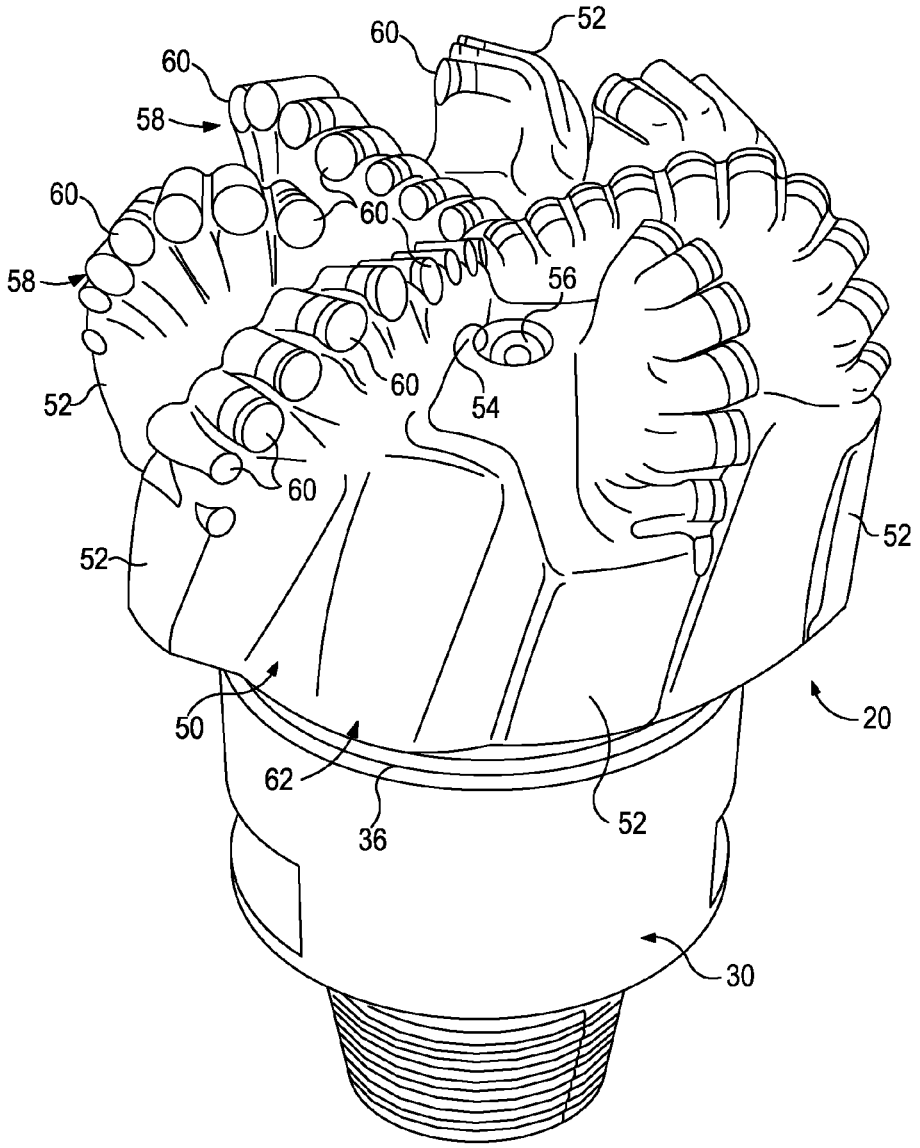
FIG. 2 is an isometric view of the drill bit of FIG. 1.

A plurality of indentations or pockets 58 are formed in the matrix bit body 50 and are shaped or otherwise configured to receive cutting elements (shown in FIG. 2).

FIG. 2 is an isometric view of the matrix drill bit 20 formed with the matrix bit body 50 that includes a precipitation hardened composite material in accordance with the teachings of the present disclosure. As illustrated, the matrix drill bit 20 includes the metal blank 36 and the metal shank 30, as generally described above with reference to FIG. 1.

The matrix bit body 50 includes a plurality of cutter blades 52 formed on the exterior of the matrix bit body 50. Cutter blades 52 may be spaced from each other on the exterior of the matrix bit body 50 to form fluid flow paths or junk slots 62 therebetween.

As illustrated, the plurality of pockets 58 may be formed in the cutter blades 52 at selected locations. A cutting element 60 (alternatively referred to as a cutting insert) may be securely mounted (e.g., via brazing) in each pocket 58 to engage and remove portions of a subterranean formation during drilling operations. More particularly, the cutting elements 60 may scrape and gouge formation materials from the bottom and sides of a wellbore during rotation of the matrix drill bit 20 by an attached drill string. For some applications, various types of polycrystalline diamond compact (PDC) cutters may be used as cutting elements 60. A matrix drill bit having such PDC cutters may sometimes be referred to as a "PDC bit".

A nozzle 56 may be disposed in each nozzle opening 54. For some applications, nozzles 56 may be described or otherwise characterized as "interchangeable" nozzles.

Figure 3:
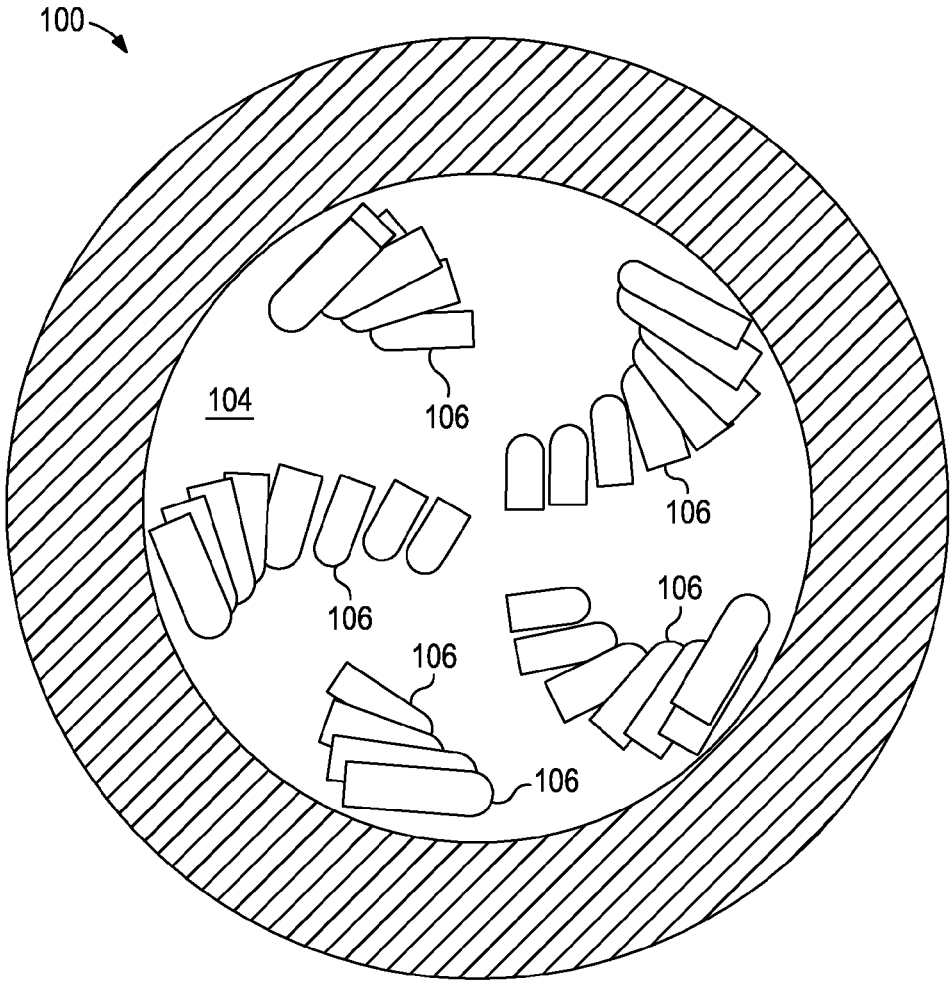
FIG. 3 is a cross-sectional view showing one example of a mold assembly for use in forming a matrix bit body in accordance with the teachings of the present disclosure.

FIG. 3 is an end view showing one example of a mold assembly 100 for use in forming a matrix bit body incorporating teachings of the present disclosure. A plurality of mold inserts 106 may be placed within the cavity 104 of the mold assembly 100 to form the respective pockets in each blade of the matrix bit body. The location of mold inserts 106 in cavity 104 corresponds with desired locations for installing the cutting elements in the associated blades. Mold inserts 106 may be formed from various types of material such as, but not limited to, consolidated sand and graphite.

Various types of temporary materials may be installed within mold cavity 104, depending upon the desired configuration of a resulting matrix drill bit. Additional mold inserts (not expressly shown) may be formed from various materials such as consolidated sand and/or graphite may be disposed within mold cavity 104. Such mold inserts may have configurations corresponding to the desired exterior features of the matrix drill bit (e.g., junk slots).

Figure 4:
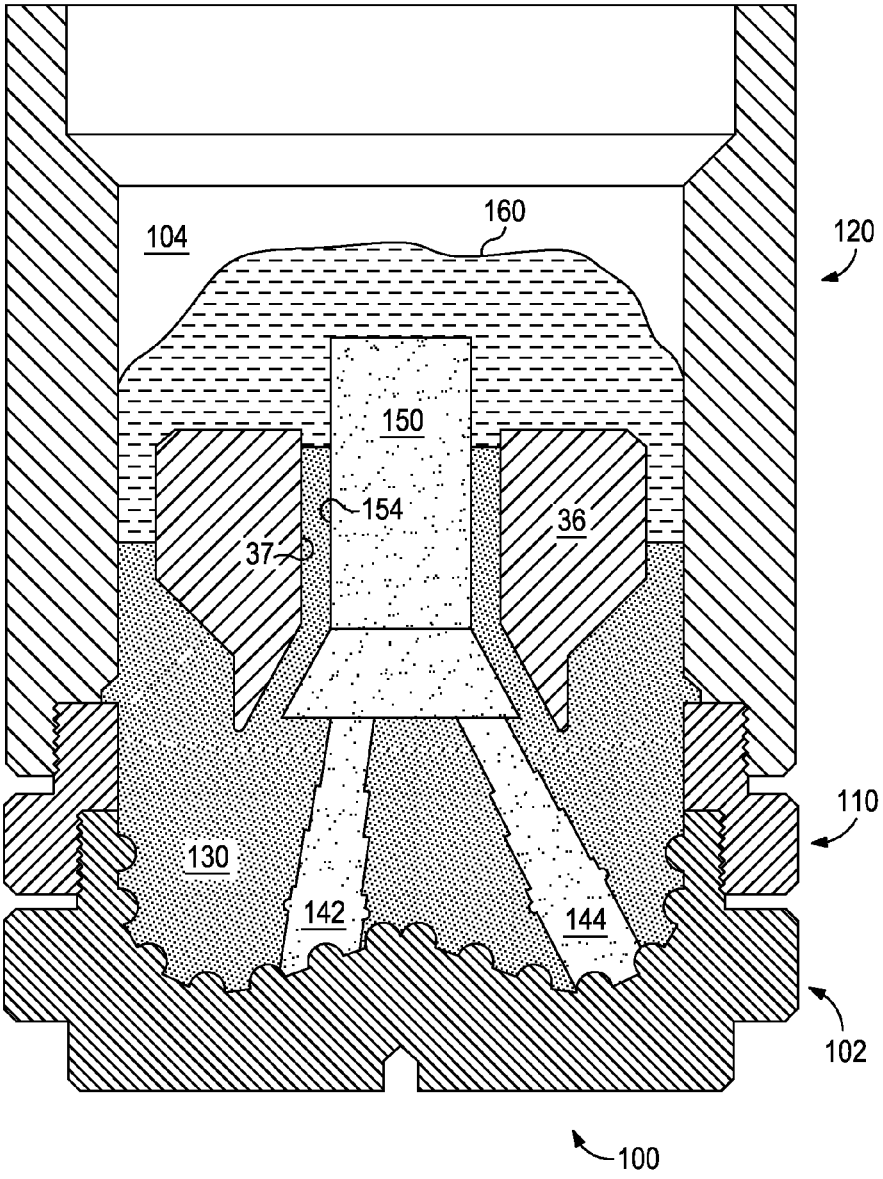
FIG. 4 is an end view showing one example of a mold assembly for use in forming a matrix bit body in accordance with the teachings of the present disclosure.

FIG. 4 is a cross-sectional view of the mold assembly 100 of FIG. 3 that may be used in forming a matrix bit body incorporating the teachings of the present disclosure. A wide variety of molds may be used to form a matrix bit body in accordance with the teachings of the present disclosure.

The mold assembly 100 may include several components such as a mold 102, a gauge ring or connector ring 110, and a funnel 120. Mold 102, gauge ring 110, and funnel 120 may be formed from graphite, for example, or other suitable materials. A cavity 104 may be defined or otherwise provided within the mold assembly 100. Various techniques may be used to manufacture the mold assembly 100 and components thereof including, but not limited to, machining a graphite blank to produce the mold 102 with the associated cavity 104 having a negative profile or a reverse profile of desired exterior features for a resulting matrix bit body. For example, the cavity 104 may have a negative profile that corresponds with the exterior profile or configuration of the blades 52 and the junk slots 62 formed therebetween, as shown in FIGS. 1-2.

Referring still to FIG. 4, materials (e.g., consolidated sand) may be installed within the mold assembly 100 at desired locations to form the exterior features of the matrix drill bit (e.g., the fluid cavity and the flow passageways). Such materials may have various configurations. For example, the orientation and configuration of the consolidated sand legs 142 and 144 may be selected to correspond with desired locations and configurations of associated flow passageways and their respective nozzle openings. The consolidated sand legs 142 and 144 may be coupled to threaded receptacles (not expressly shown) for forming the threads of the nozzle openings that couple the respective nozzles thereto.

A relatively large, generally cylindrically-shaped consolidated sand core 150 may be placed on the legs 142 and 144. Core 150 and legs 142 and 144 may be sometimes described as having the shape of a "crow's foot," and core 150 may be referred to as a "stalk." The number of legs 142 and 144 extending from core 150 will depend upon the desired number of flow passageways and corresponding nozzle openings in a resulting matrix bit body. The legs 142 and 144 and the core 150 may also be formed from graphite or other suitable materials.

After the desired materials, including the core 150 and legs 142 and 144, have been installed within mold assembly 100, the matrix material 130 may then be placed within or otherwise introduced into the mold assembly 100. After a sufficient volume of the matrix material 130 has been added to the mold assembly 100, a metal blank 36 may then be placed within mold assembly 100. The amount of matrix material 130 added to the mold assembly 100 before addition of the metal blank 36 depends on the configuration of the metal blank 36 and the desired positioning of the metal blank 36 within the mold assembly 100. Typically, the metal blank 36 is supported at least partially by the matrix material 130.

The metal blank 36 preferably includes an inside diameter 37, which is larger than the outside diameter 154 of sand core 150. Various fixtures (not expressly shown) may be used to position the metal blank 36 within the mold assembly 100 at a desired location. Then, the matrix material 130 may be filled to a desired level within the cavity 104.

Binder material 160 may be placed on top of the matrix material 130, metal blank 36, and core 150. In some embodiments, the binder material 160 may be covered with a flux layer (not expressly shown). The amount of binder material 160 and optional flux material added to cavity 104 should be at least enough to infiltrate the matrix material 130 during the infiltration process. In some instances, excess binder material 160 may be used, which after infiltration may be removed by machining.

A cover or lid (not expressly shown) may be placed over the mold assembly 100. The mold assembly 100 and materials disposed therein may then be preheated and then placed in a furnace (not expressly shown). When the furnace temperature reaches the melting point of the binder material 160, the binder material 160 may proceed to liquefy and infiltrate the matrix material 130.

After a predetermined amount of time allotted for the liquefied binder material 160 to infiltrate matrix material 130, the mold assembly 100 may then be cooled, thereby producing a hard composite material (i.e., a binder infiltrated matrix material) (not shown). Once cooled, the hard composite material may be exposed to a heat treatment designed to precipitate intermetallic particles from the binder material (described in more detail herein), thereby producing a precipitation hardened composite material. After the heat treatment, the mold assembly 100 may be broken away to expose the matrix bit body that includes the precipitation hardened composite material. Subsequent processing and machining according to well-known techniques may be used to produce a matrix drill bit that includes the matrix bit body.

The conditions of a heat treatment suitable for precipitating intermetallic particles from the binder material may depend on, inter alia, the particular composition of the binder material, the desired size range of the precipitated intermetallic particles, and the like. In some instances, the heat treatment may involve heating the hard composite material to a temperature ranging from a lower limit of 300° C., 320° C., or 340° C. to an upper limit of 400° C., 380° C., 360° C., or 340° C. for a time ranging from a lower limit of 1 hour, 2 hours, or 2.5 hours to an upper limit of 5 hours, 4 hours, or 3 hours, and wherein the temperature and time may independently may range from any lower limit to any upper limit and encompasses any subset therebetween.

In some embodiments, a series of heat treatment suitable for precipitating intermetallic particles may be performed. In some instances, each of the heat treatments in the series may be the same. In some instances, one or more (including all) of the heat treatments in the series may be the different.

Examples of binders suitable for use in conjunction with the embodiments described herein may include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Nonlimiting examples of binders may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially available binders may include, but not be limited to, VIRGIN™ Binder 453D (copper-manganese-nickel-zinc, available from Belmont Metals, Inc.); copper-tin-manganese-nickel and copper-tin-manganese-nickel-iron grades 516, 519, 523, 512, 518, and 520 available from ATI Firth Sterling; and any combination thereof.

In some embodiments, at least some of the precipitated intermetallic particles may include a transition metal. In some embodiments, at least some of the precipitated intermetallic particles may include at least two of manganese, nickel, copper, aluminum, titanium, iron, chromium, zinc, vanadium, or the like. For example, precipitated intermetallic particles may include CuM, $Cu_3M$, or both where M is a transition metal (e.g., the foregoing transition metals).

In some embodiments, at least some of the precipitated intermetallic particles may have a size in at least one dimension ranging from a lower limit of 1 micron, 5 microns, or 10 microns to an upper limit of 30 microns, 25 microns, or 20 microns, and wherein the size in at least one dimension may range from any lower limit to any upper limit and encompasses any subset therebetween. For example, at least some of the precipitated intermetallic particles may be elongated particles with a length ranging from 1 micron to 30 microns, including any subset therebetween. In another example, at least some of the precipitated particles may be substantially spherical with a diameter ranging from 1 micron to 30 microns, including any subset therebetween.

In some instances, matrix particles suitable for use in conjunction with the embodiments described herein may include particles of metals, metal alloys, metal carbides, metal nitrides, diamonds, superalloys, and the like, or any combination thereof. Examples of matrix particles suitable for use in conjunction with the embodiments described herein may include particles that include, but not be limited to, nitrides, silicon nitrides, boron nitrides, cubic boron nitrides, natural diamonds, synthetic diamonds, cemented carbide, spherical carbides, low alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, chromium alloys, HASTELLOY® alloys (nickel-chromium containing alloys, available from Haynes International), INCONEL® alloys (austenitic nickel-chromium containing superalloys, available from Special Metals Corporation), WASPALOYS® (austenitic nickel-based superalloys, available from United Technologies Corp.), RENE® alloys (nickel-chrome containing alloys, available from Altemp Alloys, Inc.), HAYNES® alloys (nickel-chromium containing superalloys, available from Haynes International), INCOLOY® alloys (iron-nickel containing superalloys, available from Mega Mex), MP98T (a nickel-copper-chromium superalloy, available from SPS Technologies), TMS alloys, CMSX® alloys (nickel-based superalloys, available from C-M Group), N-155 alloys, any mixture thereof, and any combination thereof. In some embodiments, the matrix particles may be coated. By way of nonlimiting example, the matrix particles may include diamond coated with titanium.

In some embodiments, at least some of the matrix particles described herein may have a diameter ranging from a lower limit of 50 microns, 100 microns, or 200 microns to an upper limit of 1000 microns, 800 microns, 500 microns, 400 microns, or 200 microns, wherein the diameter of the matrix particles may range from any lower limit to any upper limit and encompasses any subset therebetween.

In some embodiments, at least some of the matrix particles described herein may have smaller diameters (e.g., less than 5 microns) and provide nucleation sites for forming the precipitated intermetallic particles. In some embodiments, at least some of the matrix particles described herein may have a diameter ranging from a lower limit of 0.1 microns, 0.5 microns, or 1 microns to an upper limit of 5 microns, 3 microns, or 1 micron, wherein the diameter of the matrix particles may range from any lower limit to any upper limit and encompasses any subset therebetween.

In some embodiments, the matrix particles with smaller diameters (e.g., less than 5 microns) may be less than 5% by weight of the matrix particles (or less than 1% by weight of the matrix particles). In some embodiments, the matrix particles with smaller diameters (e.g., less than 5 microns) may be at a concentration ranging from a lower limit of 0.1%, 0.5%, or 1% by weight of the matrix particles to an upper limit of 5%, 3%, or 1% by weight of the matrix particles, wherein the concentration of the matrix particles may range from any lower limit to any upper limit and encompasses any subset therebetween.

Figure 5:
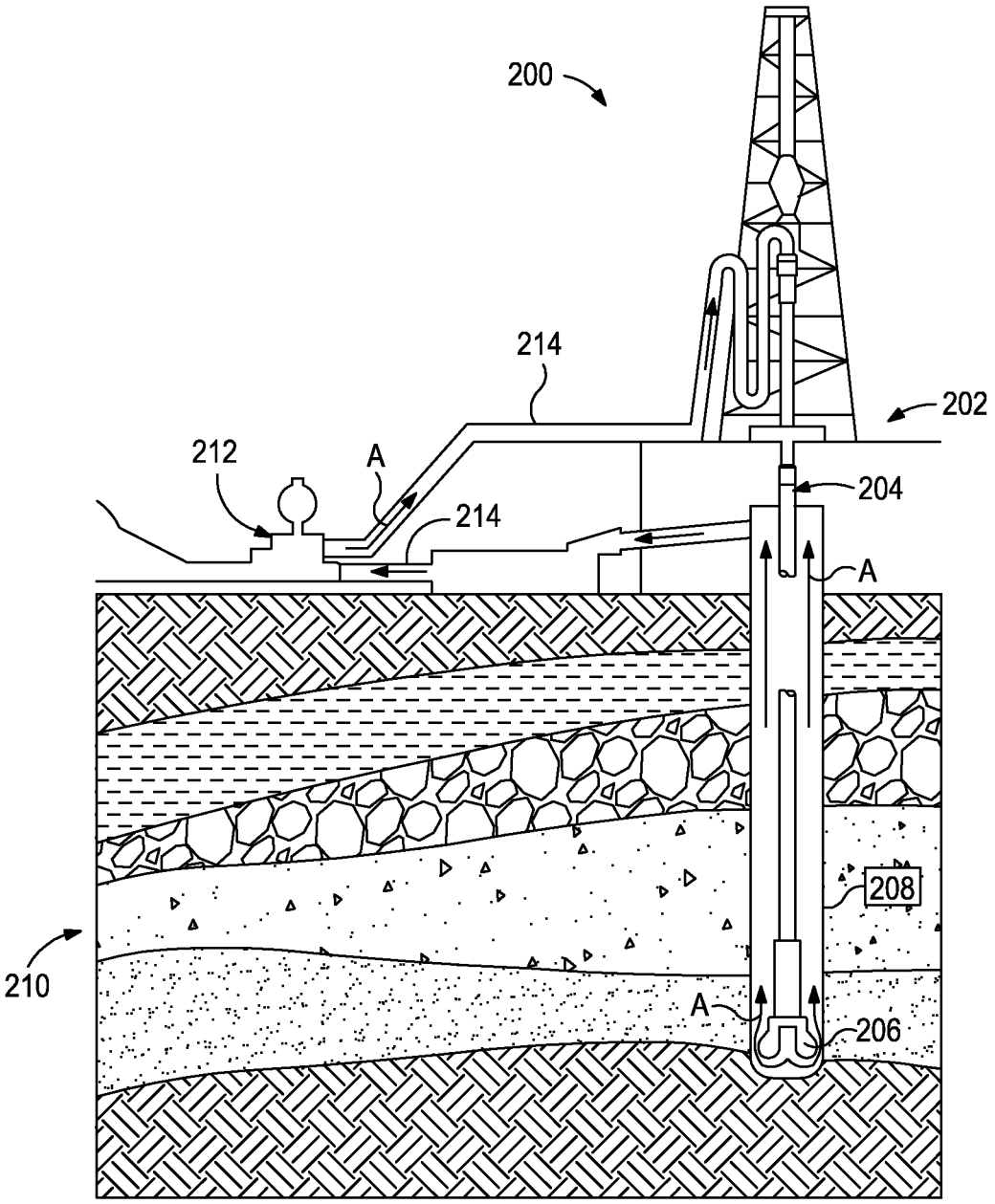
FIG. 5 is a schematic drawing showing one example of a drilling assembly suitable for use in conjunction with the matrix drill bits of the present disclosure.

FIG. 5 is a schematic showing one example of a drilling assembly 200 suitable for use in conjunction with the matrix drill bits of the present disclosure. It should be noted that while FIG. 5 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 200 includes a drilling platform 202 coupled to a drill string 204. The drill string 204 may include, but is not limited to, drill pipe and coiled tubing, as generally known to those skilled in the art apart from the particular teachings of this disclosure. A matrix drill bit 206 according to the embodiments described herein is attached to the distal end of the drill string 204 and is driven either by a downhole motor and/or via rotation of the drill string 204 from the well surface. As the drill bit 206 rotates, it creates a wellbore 208 that penetrates the subterranean formation 210. The drilling assembly 200 also includes a pump 212 that circulates a drilling fluid through the drill string (as illustrated as flow arrows A) and other pipes 214.

One skilled in the art would recognize the other equipment suitable for use in conjunction with drilling assembly 200, which may include, but are not limited to, retention pits, mixers, shakers (e.g., shale shaker), centrifuges, hydrocyclones, separators (including magnetic and electrical separators), desilters, desanders, filters (e.g., diatomaceous earth filters), heat exchangers, and any fluid reclamation equipment. Further, the drilling assembly may include one or more sensors, gauges, pumps, compressors, and the like.

Embodiments disclosed herein include:

A. a drill bit that includes a matrix bit body having matrix particles and precipitated intermetallic particles dispersed in a binder, at least some of the matrix particles having a diameter of 50 microns or greater, and at least some of the precipitated intermetallic particles having at least one dimension of 1 micron to 30 microns; and a plurality of cutting elements coupled to an exterior portion of the matrix bit body;

B. a method that includes liquefying a binder material to provide a liquefied binder; infiltrating matrix particles disposed in a drill bit mold with the liquefied binder, at least some of the matrix particles having a diameter of 50 microns or greater; cooling the matrix particles infiltrated with the binder to form a hard composite material; and heat treating the hard composite material at 300° C. to 400° C. for 1 hour to 5 hours to yield a precipitation hardened composite material having the matrix particles and the precipitated intermetallic particles dispersed in the binder material, wherein at least some of the precipitated intermetallic particles have at least one dimension being 1 micron to 30 microns; and C. a drilling assembly that includes a drill string extendable from a drilling platform and into a wellbore; a pump fluidly connected to the drill string and configured to circulate a drilling fluid into the drill string and through the wellbore; and a drill bit (according to Embodiment A) attached to an end of the drill string.

Each of Embodiments A, B, C may have one or more of the following additional elements in any combination: Element 1: wherein the diameter of at least some of the matrix particles is 100 microns to 1000 microns; Element 2: wherein the matrix particles are first matrix particles and the matrix bit body further includes second matrix particles, wherein at least some of the second matrix particles have a diameter less than 5 microns; Element 3: Element 2 wherein at least some of the second matrix particles have a diameter less than 1 micron; Element 4: Element 2 wherein the second matrix particles are less than 5% by weight of a total of the first matrix particles and the second matrix particles; Element 5: Element 2, wherein the second matrix particles are less than 1% by weight of a total of the first matrix particles and the second matrix particles; Element 6: wherein the precipitated intermetallic particles include a transition metal; Element 7: wherein the precipitated intermetallic particles include at least two of manganese, nickel, copper, aluminum, titanium, iron, chromium, zinc, or vanadium; Element 8: wherein the precipitated intermetallic particles include at least one of: CuM or $Cu_3M$, wherein M is a transition metal selected from the group consisting of manganese, nickel, aluminum, titanium, iron, chromium, zinc, and vanadium; and Element 9: wherein the binder material (or binder) includes at least one selected from the group consisting of copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof.

By way of non-limiting example, exemplary combinations applicable to Embodiments A, B, C include: Element 3 in combination with Element 4; Element 3 in combination with Element 5; Element 2 in combination with one of Elements 6-8 and optionally in further combination with at least one of Elements 3-5; Element 1 in combination with any of the foregoing; Element 8 in combination with any of the foregoing; Element 1 in combination with one of Elements 2-9; and Element 9 in combination with one of Elements 1-8.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A drill bit comprising:

a matrix bit body having matrix particles and precipitated intermetallic particles dispersed in a binder, at least some of the matrix particles having a diameter of 50 microns or greater, and at least some of the precipitated intermetallic particles having at least one dimension of 1 micron to 30 microns; and a plurality of cutting elements coupled to an exterior portion of the matrix bit body, wherein the matrix particles include first matrix particles having a diameter greater than or equal to five microns and second matrix particles having a diameter less than five microns, and the second matrix particles are less than 5% by weight of a total of the first matrix particles and the second matrix particles.

2. The drill bit of claim 1, wherein the diameter of at least some of the matrix particles is 100 microns to 1000 microns.

3. The drill bit of claim 1, wherein at least some of the second matrix particles have a diameter less than 1 micron.

4. The drill bit of claim 1, wherein the second matrix particles are less than 1% by weight of a total of the first matrix particles and the second matrix particles.

5. The drill bit of claim 1, wherein the precipitated intermetallic particles include a transition metal.

6. The drill bit of claim 1, wherein the precipitated intermetallic particles include at least two of manganese, nickel, copper, aluminum, titanium, iron, chromium, zinc, or vanadium.

7. The drill bit of claim 1, wherein the precipitated intermetallic particles include at least one of: CuM or $Cu_3M$, wherein M is a transition metal selected from the group consisting of manganese, nickel, aluminum, titanium, iron, chromium, zinc, and vanadium.

8. A drilling assembly comprising:

a drill string extendable from a drilling platform and into a wellbore;

a pump fluidly connected to the drill string and configured to circulate a drilling fluid into the drill string and through the wellbore; and a drill bit attached to an end of the drill string, the drill bit having a matrix bit body and a plurality of cutting elements coupled to an exterior portion of the matrix bit body, wherein the matrix bit body includes matrix particles and precipitated intermetallic particles dispersed in a binder, at least some of the matrix particles having a diameter of 50 microns or greater, and at least some of the precipitated intermetallic particles having at least one dimension of 1 micron to 30 microns, wherein the matrix particles include first matrix particles having a diameter greater than or equal to five microns and second matrix particles having a diameter less than five microns, and the second matrix particles are less than 5% by weight of a total of the first matrix particles and the second matrix particles.

* * * * *